US007780481B2

(12) United States Patent
Chen et al.

(10) Patent No.: US 7,780,481 B2
(45) Date of Patent: Aug. 24, 2010

(54) COMPOSITE CONNECTOR ASSEMBLY AND POWER SUPPLY APPARATUS HAVING SUCH COMPOSITE CONNECTOR ASSEMBLY

(75) Inventors: Hung-Chuan Chen, Taoyuan Hsien (TW); Hung-Chang Hsieh, Taoyuan Hsien (TW)

(73) Assignee: Delta Electronics, Inc., Taoyuan Hsien (TW)

( * ) Notice: Subject to any disclaimer, the term of this patent is extended or adjusted under 35 U.S.C. 154(b) by 279 days.

(21) Appl. No.: 11/950,101

(22) Filed: Dec. 4, 2007

(65) Prior Publication Data

US 2008/0139022 A1 Jun. 12, 2008

Related U.S. Application Data

(63) Continuation-in-part of application No. 11/534,104, filed on Sep. 21, 2006, now abandoned.

(30) Foreign Application Priority Data

May 25, 2007 (TW) ..... 96118794 A

(51) Int. Cl.
*H01R 9/22* (2006.01)

(52) U.S. Cl. ..... 439/717; 439/358

(58) Field of Classification Search ..... 439/717, 439/701, 594, 540.1, 541.5, 352–353, 357–358
See application file for complete search history.

(56) References Cited

U.S. PATENT DOCUMENTS 2,957,155 A 10/1960 Ehrlich
4,184,733 A 1/1980 Schmeling
4,469,393 A 9/1984 Chewning, Jr. et al.
4,729,744 A * 3/1988 Bet et al. ..... 439/717
4,797,123 A 1/1989 Weber
5,137,462 A * 8/1992 Casey et al. ..... 439/74
5,431,586 A * 7/1995 Klas et al. ..... 439/676
5,702,021 A * 12/1997 Ito ..... 220/326
6,179,650 B1 * 1/2001 Chih-Kai ..... 439/540.1
6,786,740 B2 * 9/2004 Ito ..... 439/76.2
6,935,902 B1 8/2005 Chou
7,187,544 B2 * 3/2007 Tsai ..... 307/43

* cited by examiner

*Primary Examiner*—Xuong M Chung-Trans
(74) *Attorney, Agent, or Firm*—Kirton & McConkie; Evan R. Witt

(57) ABSTRACT

A power supply apparatus includes a main body, a power input device, a first power output device and a second power output device. The first power output device includes a first cable and a first connector. The first cable is connected to a first surface of the first connector and includes at least a stop block and at least a fastening element. The second power output device includes a second cable and a second connector. The second cable is connected to a first surface of the second connector and includes an extension part and a retaining wall. An edge of the retaining wall is confined by the stop block and the extension part is clamped by the fastening element so as to selectively combine the first connector with the second connector as a composite connector assembly and facilitate securely fixing the composite connector assembly in a common power socket.

12 Claims, 11 Drawing Sheets

COMPOSITE CONNECTOR ASSEMBLY AND POWER SUPPLY APPARATUS HAVING SUCH COMPOSITE CONNECTOR ASSEMBLY

CROSS-REFERENCE TO RELATED APPLICATION

This application is a continuation-in-part of U.S. patent application Ser. No. 11/534,104, filed on Sep. 21, 2006, and entitled "POWER SUPPLY APPARATUS HAVING MULTIPLE POWER OUTPUT DEVICES". The entire disclosure of the above application is incorporated herein by reference.

FIELD OF THE INVENTION

The present invention relates to a composite connector assembly, and more particularly to a composite connector assembly selectively combined by two individual connectors. The present invention also relates to a power supply apparatus having such a composite connector assembly.

BACKGROUND OF THE INVENTION

Power supply apparatuses are essential for many electronic appliances such as personal computers, industrial computers, servers, communication products or network products. Usually, the user may simply plug a power supply apparatus into an AC wall outlet commonly found in most homes or offices so as to receive an AC voltage. The power supply apparatus will convert the AC voltage into a regulated DC output voltage for powering the electronic device and/or charging a battery built-in the electronic device.

Referring to FIG. 1, a schematic perspective view of a conventional power supply apparatus having multiple power output devices is illustrated. The power supply apparatus 1 includes a main body 10, a power input device 11, a first power output device 12 and a second power output device 13. The power input device 11 is connected to the input terminal of the main body 10 for receiving an AC voltage from an external power source. The first power output device 12 and the second power output device 13 are connected to the output terminals of the main body 10. The AC voltage transmitted from the external power source is converted by the circuitry of a printed circuit board inside the main body 10 into different regulated DC output voltages. The different regulated DC output voltages are outputted from the power output devices 12 and 13 for powering different electronic devices (not shown). The first power output device 12 includes a first cable 121 and a first connector 122. The second power output device 13 includes a second cable 131 and a second connector 132. The first connector 122 is connected to an end of the first cable 121. The second connector 132 is connected to an end of the second cable 131.

For example, when the power supply apparatus 1 is applied to a personal computer system, the first connector 122 of the first power output device 12 and the second connector 132 of the second power output device 13 should be plugged into corresponding sockets (not shown) on the motherboard of the computer system. For complying with the specifications of corresponding sockets on the motherboard, the first connector 122 of the first power output device 12 is a 20- or 24-pin connector to be coupled with the 20- or 24-hole socket (i.e. the first power socket). The second connector 132 of the second power output device 13 is a 4- or 8-pin connector to be coupled with the 4- or 8-hole socket (i.e. the second power socket). As known, the pin numbers of the first connector 122 and the second connector 132 should be equal to those of the first power socket and the second power socket, respectively. For example, the 20-pin first connector fails to be applied to the 24-hole first power socket, and the 4-pin second connector fails to be applied to the 8-hole second power socket. For complying with the power sockets with different number of holes, at least two power supply apparatuses should be purchased, which is costly and wastes resources.

For solving the above problems, a power supply apparatus having a composite connector assembly is disclosed in for example US Patent Application No. 2005/0202726, and the contents of which are hereby incorporated by reference. By using a single power supply apparatus, the connectors can be selectively combined or separated according to the number of holes of the power socket on the motherboard. As a consequence, such a power supply apparatus is advantageous for flexibility to be applied in different instances. Referring to FIG. 2A, the power supply apparatus 3 as disclosed in US Patent Application No. 2005/0202726 includes a main body 30 and a first connector 31. The first connector 31 is coupled to the main body 30 through a first cable 32. The first connector 31 includes a plurality of pins 33 such as twenty pins 33. The first connector 31 includes a first engaging element 34 such as a protrusion track at a left side thereof.

The power supply apparatus 3 further comprises a second connector 35. The second connector 35 is coupled to the main body 30 through a second cable 36. The second connector 35 includes a plurality of pins 38 such as four pins 38. The second connector 35 further includes a second engaging element 37 such as a gliding channel at a right side thereof and corresponding to the first engaging element 34 of the first connector 31. Once the first engaging element 34 is coupled with the second engaging element 37, the first connector 31 and the second connector 35 are combined as a composite connector assembly having a total number of twenty four pins, as can be seen in FIG. 2B.

Please refer to FIG. 2A again. The power supply apparatus 3 further comprises a third connector 40. The third connector 40 is coupled to the main body 30 through a third cable 41. The third connector 40 includes a plurality of pins 42 such as four pins 42. The third connector 40 further includes a third engaging element 43 such as a protrusion track at a left side thereof. The power supply apparatus 3 further comprises a fourth connector 44. The fourth connector 44 is coupled to the main body 30 through a fourth cable 45. The fourth connector 44 includes a plurality of pins 47 such as four pins 44. The fourth connector 44 further includes a fourth engaging element 46 such as a gliding channel at a right side thereof and corresponding to the third engaging element 43 of the third connector 40. Once the third engaging element 43 is coupled with the fourth engaging element 46, the third connector 40 and the fourth connector 44 are combined as another composite connector assembly having a total number of eight pins, as can be also seen in FIG. 2B.

Please refer to FIGS. 3A and 3B, which are partial exploded views illustrating the power supply apparatus 3 to be used in a motherboard having two power sockets. The motherboard 50 has a first power socket 51 and a second power socket 53 mounted thereon. In a case that the first power socket 51 has twenty holes 52 and the second power socket 53 has four holes 54, the twenty pins 33 of the first connector 31 and the four pins 38 of the second connector 35 can be plugged into corresponding holes 52 and 54 of the sockets 51 and 53, respectively.

Please refer to FIG. 4, which is a partial exploded view illustrating the power supply apparatus 3 to be used in another motherboard having two different power sockets. The motherboard 50 of FIG. 4 has a first power socket 55 and a second power socket 57 mounted thereon. In a case that the first power socket 55 has twenty four holes 56, the first connector 31 and the second connector 35 may be combined as a composite connector assembly having a total number of twenty four pins by coupling the first engaging element 34 with the second engaging element 37. As a consequence, the twenty four pins of the composite connector assembly can be plugged into the holes 56 of the first power socket 55. In another case that the second power socket 57 has eight holes 58, the third connector 40 and the fourth connector 44 may be combined as another composite connector assembly having a total number of eight pins by coupling the third engaging element 43 with the fourth engaging element 46. As a consequence, the eight pins of this composite connector assembly can be plugged into the holes 58 of the second power socket 57.

The power supply apparatus having a composite connector assembly as described above, however, still has some drawbacks. For example, since the composite connector assembly is formed by combining two individual connectors through engagement of corresponding engaging elements, the structures of individual connectors are complicated and costly. In addition, as shown in FIG. 4, the first connector 31 and the second connector 35 are combined as a composite connector assembly by moving the protrusion track 34 along the gliding channel 37 in the Z-direction. Under this circumstance, the relative movement between the first connector 31 and the second connector 35 is restricted in the XY-plane but allowable in the Z-direction. Since the composite connector assembly is plugged into the first power socket in the Z-direction, the composite connector assembly may be detached during the plugging process.

SUMMARY OF THE INVENTION

It is an object of the present invention to provide a power supply apparatus having a composite connector assembly, in which two connectors are selectively combined or separately plugged into a common power socket, thereby increasing flexibility to be applied in different instances.

Another object of the present invention provides a composite connector assembly capable of being securely fixed in the common power socket with a tiny or none shift in all directions.

A further object of the present invention provides a composite connector assembly, in which the structure of the individual connector is very simple, and thus the power supply apparatus of the present invention is cost-effective and user-friendly.

In accordance with an aspect of the present invention, there is provided a power supply apparatus. The power supply apparatus includes a main body, a power input device, a first power output device and a second power output device. The power input device is coupled to an input terminal of the main body. The first power output device includes a first cable and a first connector. The first cable has a first end connected to the main body and a second end connected to a first surface of the first connector. The first connector includes at least a stop block and at least a fastening element. The second power output device includes a second cable and a second connector. The second cable has a first end connected to the main body and a second end connected to a first surface of the second connector. The second connector includes an extension part and a retaining wall. An edge of the retaining wall is confined by the stop block and the extension part is clamped by the fastening element so as to selectively combine the first connector with the second connector as a composite connector assembly and facilitate securely fixing the composite connector assembly in a common power socket, thereby transmitting electricity from the first and second output devices to the common power socket.

In accordance with another aspect of the present invention, there is provided a composite connector assembly of a power supply apparatus. The power supply apparatus comprises a main body, a first power output device including a first cable and a second power output device including a second cable. The composite connector assembly includes a first connector and a second connector. The first connector has a first surface connected to the first cable and includes at least a stop block and at least a fastening element. The second connector has a first surface connected to the second cable and includes an extension part and a retaining wall. An edge of the retaining wall is confined by the stop block and the extension part is clamped by the fastening element so as to selectively combine the first connector with the second connector as a composite connector assembly and facilitate securely fixing the composite connector assembly in a common power socket, thereby transmitting electricity from the first and second output devices to the common power socket.

The above contents of the present invention will become more readily apparent to those ordinarily skilled in the art after reviewing the following detailed description and accompanying drawings, in which:

DETAILED DESCRIPTION OF THE PREFERRED EMBODIMENT

The present invention will now be described more specifically with reference to the following embodiments. It is to be noted that the following descriptions of preferred embodiments of this invention are presented herein for purpose of illustration and description only. It is not intended to be exhaustive or to be limited to the precise form disclosed.

Figure 1:
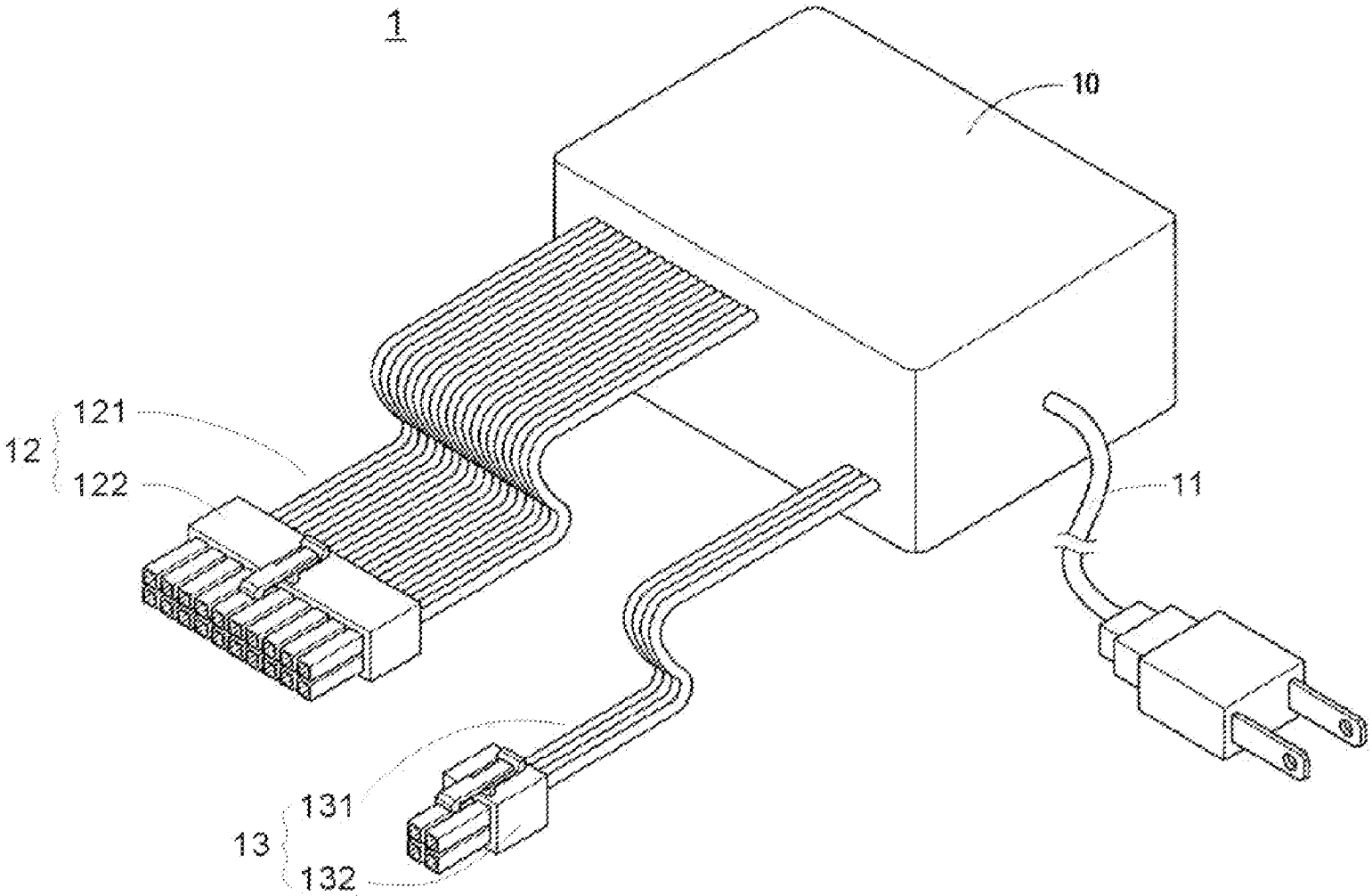
FIG.1 Prior Art
FIG. 1 is a schematic perspective view of a conventional power supply apparatus.
Figure 2A:
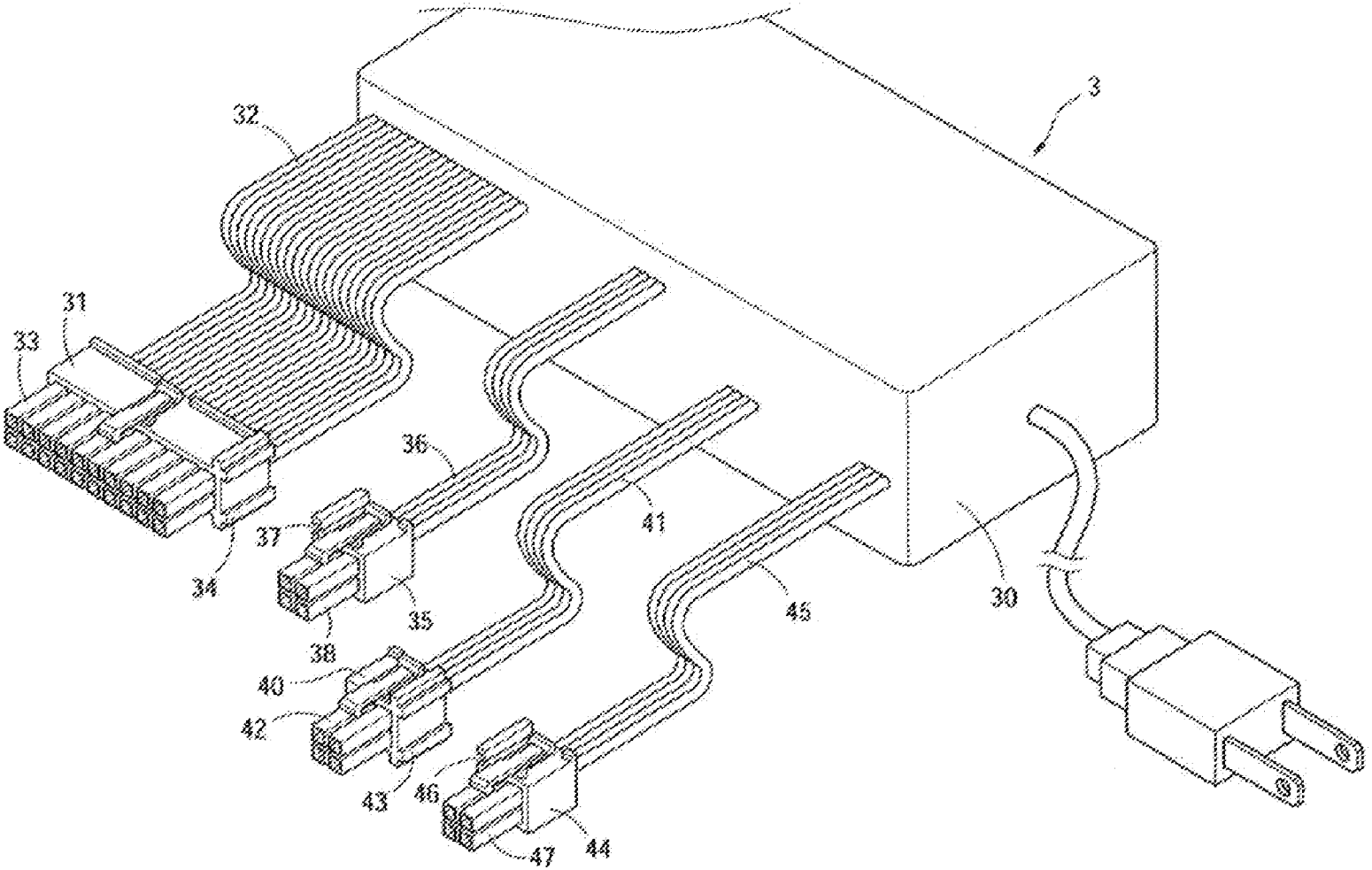
FIG.2A Prior Art
FIG. 2A is a schematic perspective view of another conventional power supply apparatus having a composite connector assembly.
Figure 2B:
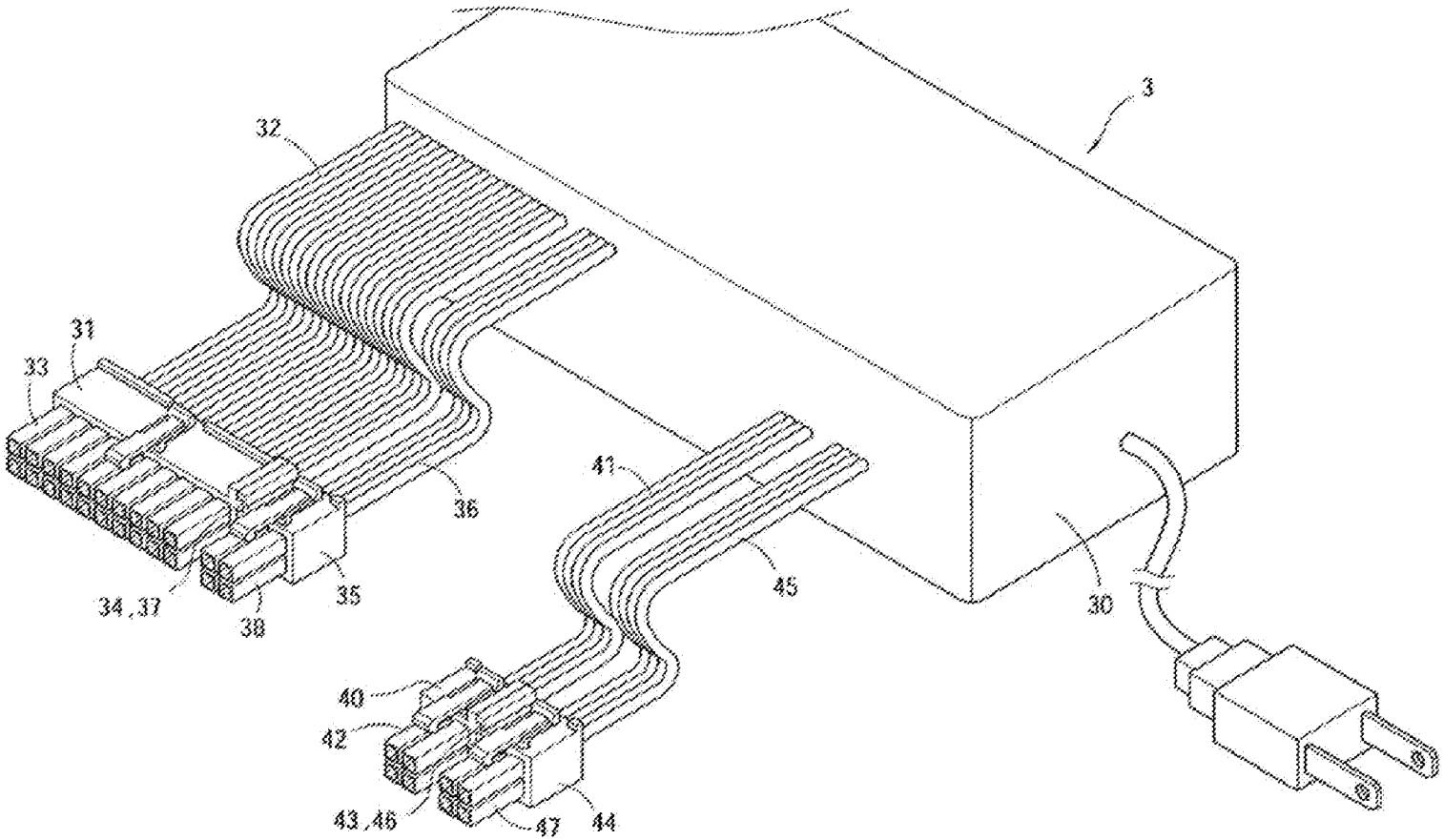
FIG.2B Prior Art
FIG. 2B is a schematic perspective view of the power supply apparatus of FIG. 2A, in which two connectors are combined as the composite connector assembly.
Figure 3B:
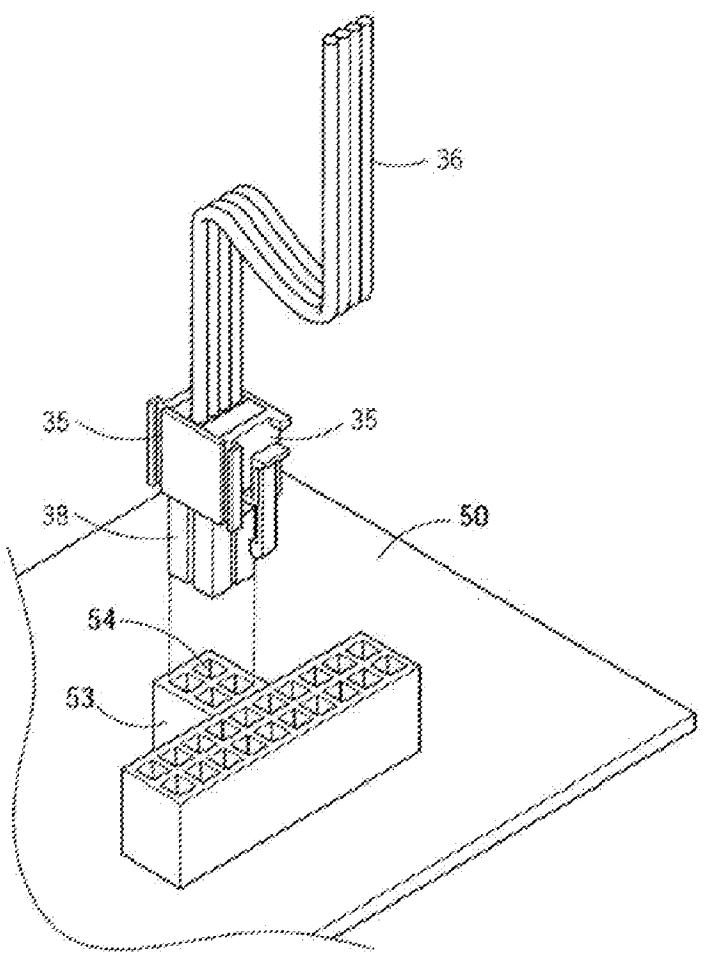
FIG.3B Prior Art
FIGS. 3A and 3B are partial exploded views illustrating the power supply apparatus of FIG. 2A to be used in a motherboard having two power sockets.
Figure 3A:
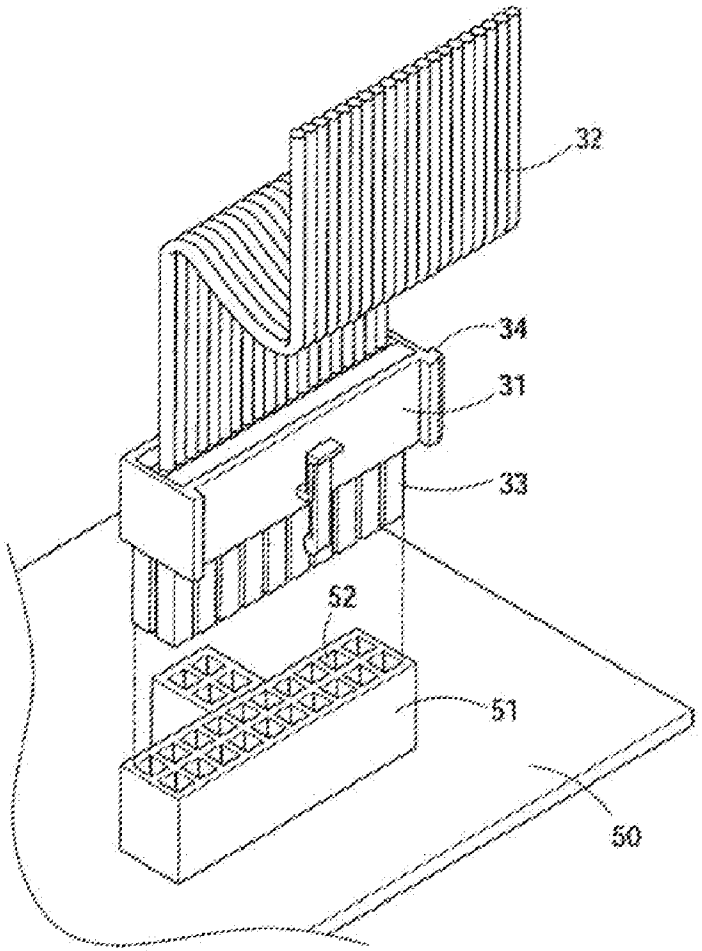
FIG.3A Prior Art
Figure 4:
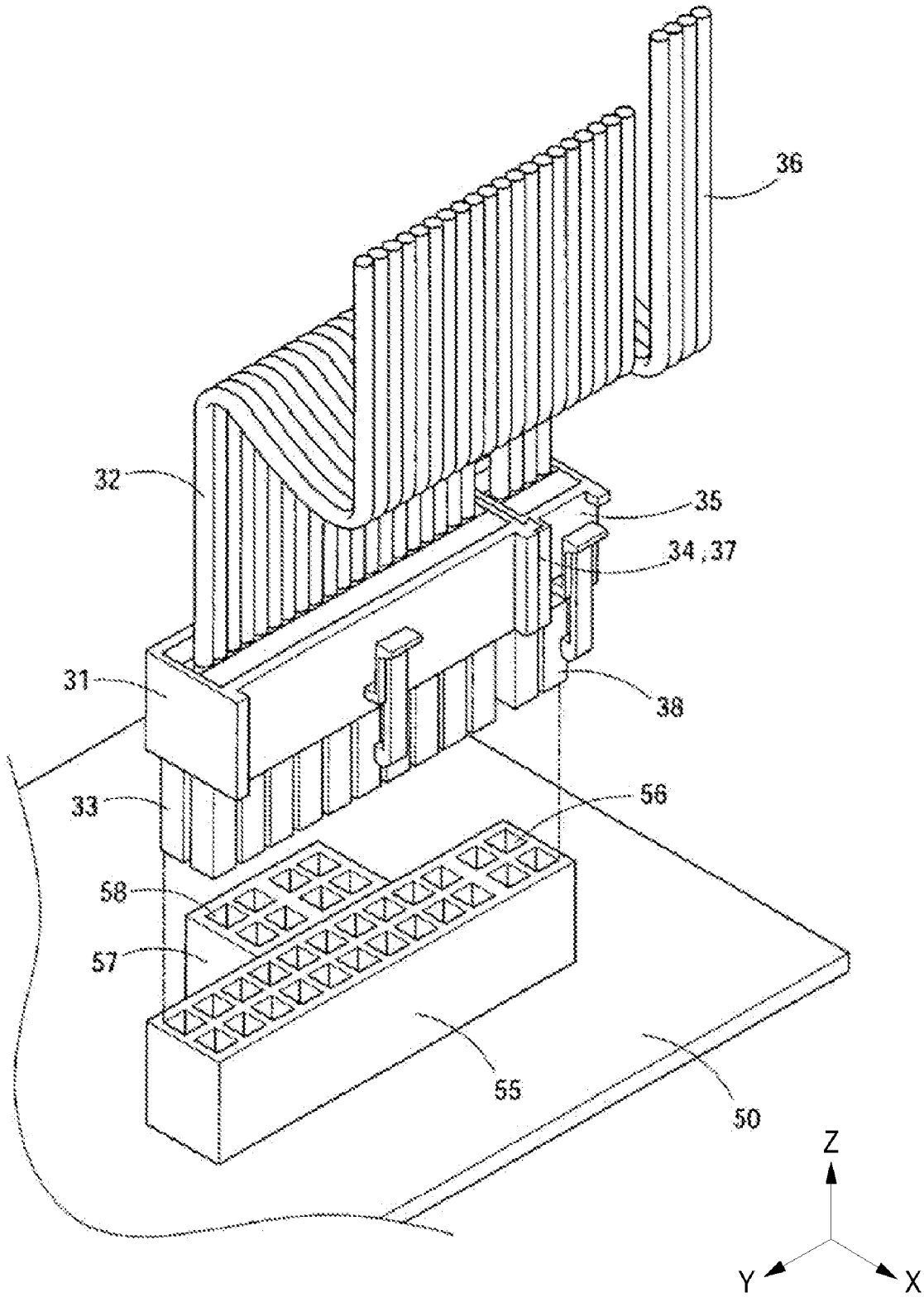
FIG.4 Prior Art
FIG. 4 is a partial exploded view illustrating the power supply apparatus of FIG. 2A to be used in another motherboard having two different power sockets.
Figure 5:
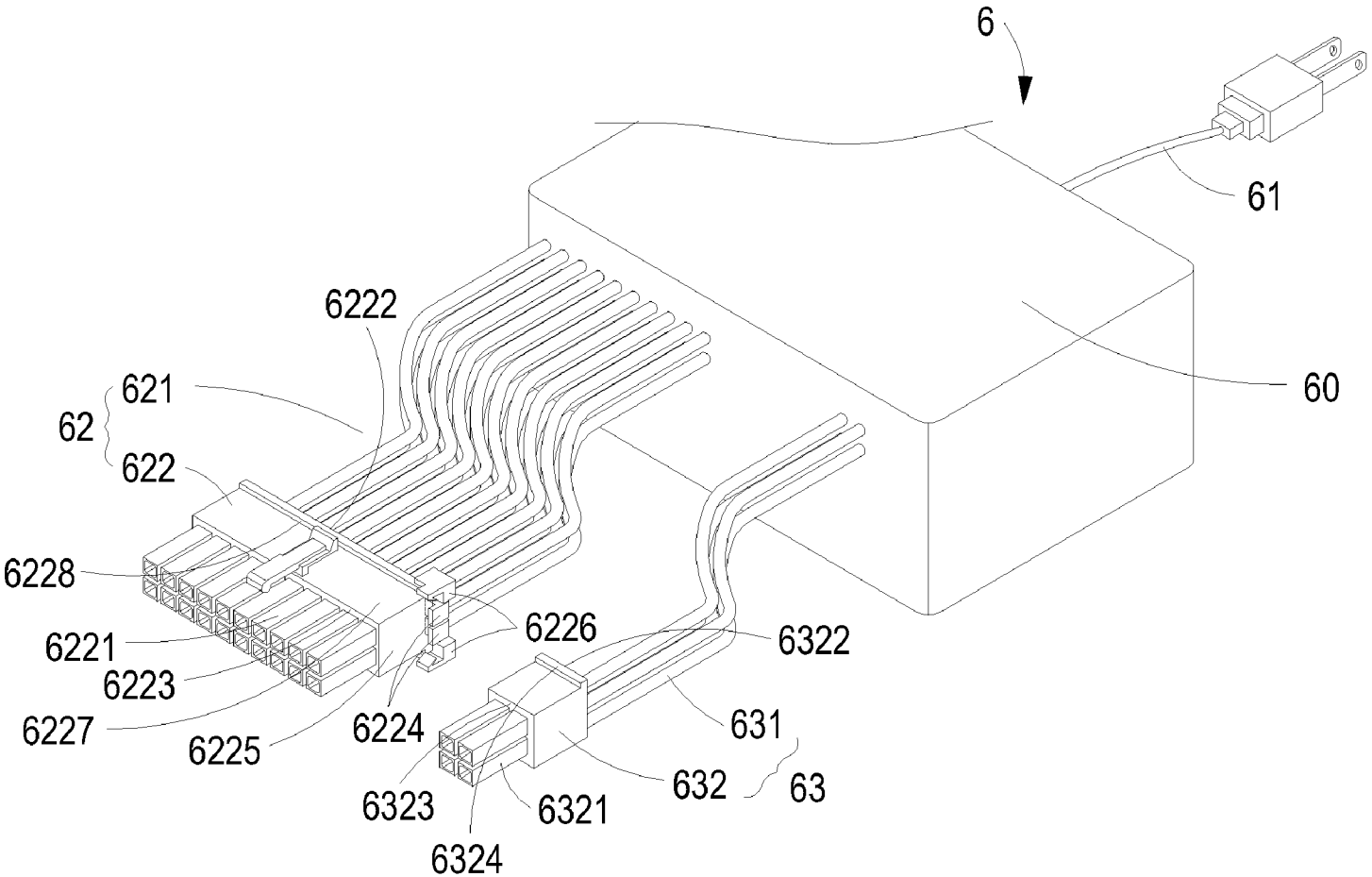
FIG. 5 is a schematic perspective view of a power supply apparatus having a composite connector assembly according to a preferred embodiment of the present invention.

Referring to FIG. 5, a schematic perspective view of a power supply apparatus having a composite connector assembly according to a preferred embodiment of the present invention is illustrated. The power supply apparatus 6 of FIG. 5 principally includes a main body 60, a power input device 61, a first power output device 62 and a second power output device 63. The power input device 61 is connected to the input terminal of the main body 60 for receiving an AC voltage from an external power source. The first power output device 62 and the second power output device 63 are connected to the output terminals of the main body 60. The AC voltage transmitted from the external power source is converted by the circuitry of a printed circuit board inside the main body 60 into different regulated DC output voltages. The regulated DC output voltages are outputted from the power output devices 62 and 63 for powering different electronic devices (not shown). The first power output device 62 includes a first cable 621 and a first connector 622. The second power output device 63 includes a second cable 631 and a second connector 632. The first cable 621 has a first end coupled to the main body 60 and a second end coupled to a first surface 6222 of the first connector 622. The second cable 631 has a first end coupled to the main body 60 and a second end coupled to a first surface 6322 of the second connector 632. The first connector 622 of the first power output device 62 and the second connector 632 of the second power output device 63 may be selectively combined as a composite connector assembly.

Figure 6:
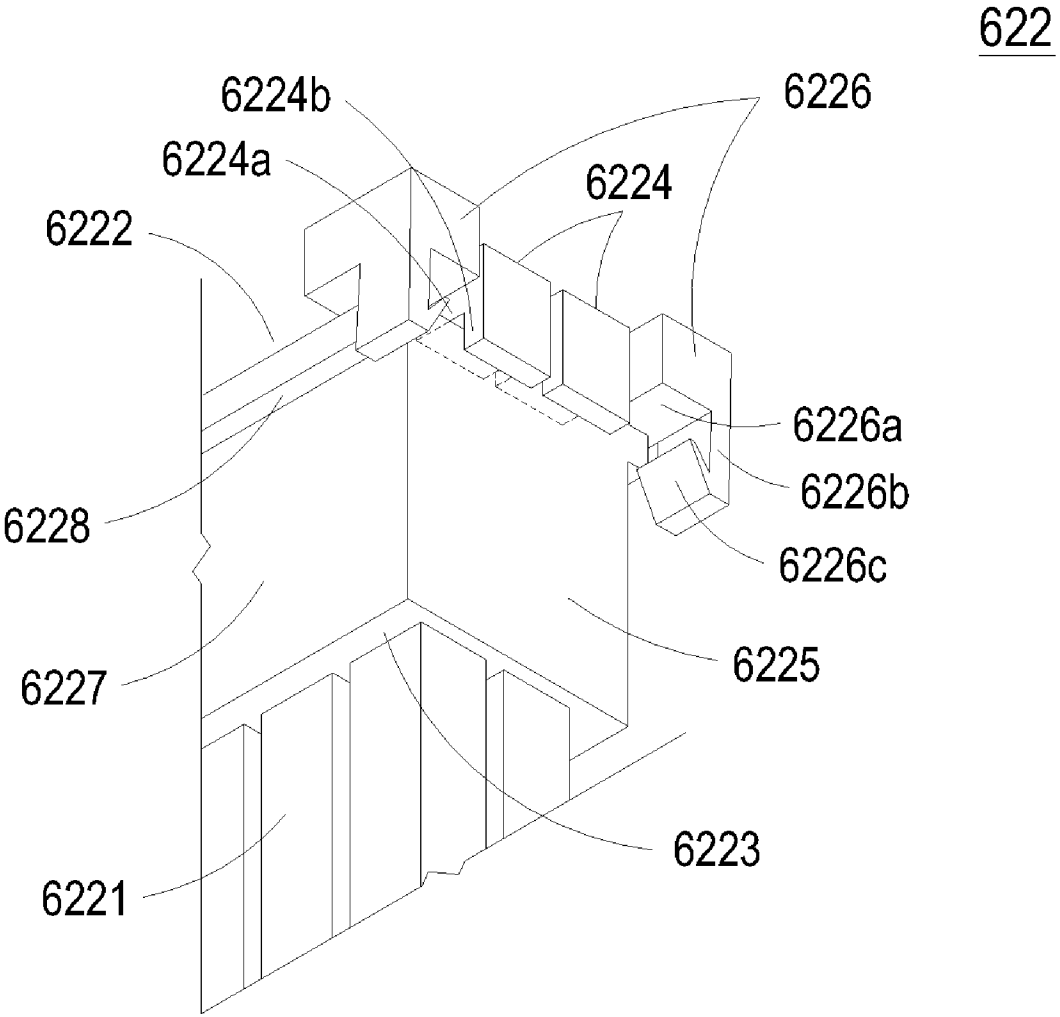
FIG. 6 is a schematic partial enlarged view illustrating a fastening element of the first connector shown in FIG. 5.

FIG. 6 is a schematic partial enlarged view of the first connector shown in FIG. 5. Please refer to FIGS. 5 and 6. The first connector 622 includes multiple (e.g. twenty) pins 6221. These pins 6221 are protruded from a second surface 6223 of the first connector 622, wherein the second surface 6223 is opposed to the first surface 6222. The first connector 622 further includes at least a stop block 6224 extended from an edge of the first surface 6222 and protruded from a first sidewall 6225, wherein the first sidewall 6225 is arranged between the first surface 6222 and the second surface 6223. The stop block 6224 includes a first segment 6224*a* and a second segment 6224*b*. The first segment 6224*a* and the second segment 6224*b* are substantially perpendicular to each other such that the stop block 6224 is L-shaped. That is, the second segment 6224*b* is substantially parallel to the first sidewall 6225. Moreover, the first segment 6224*a* has an extension structure 6228 extended from two opposite edges of the first surface 6222.

Furthermore, the first connector 622 further includes at least a fastening element 6226, which is extended from an edge or a corner of the first surface 6222 and partially protruded from the first sidewall 6225 and a second sidewall 6227 of the first connector 622. The second sidewall 6227 is disposed adjacent to the first sidewall 6225 and between the first surface 6222 and the second surface 6223.

In some embodiments, the fastening element 6226 includes a connecting part 6226*a*, an arm part 6226*b* and a hooking part 6226*c*. The connecting part 6226*a* is connected to the first surface 6222 or the extension structure 6228 of the first connector 622. The arm part 6226*b* is substantially perpendicular to the connecting part 6226*a*. The hooking part 6226*c* is formed at an end of the arm part 6226*b*. By applying an external force on the arm part 6226*b*, the hooking part 6226*c* is shifted with respect to the connecting part 6226*a* such that the first connector 622 may be combined with the second connector 632.

Figure 7:
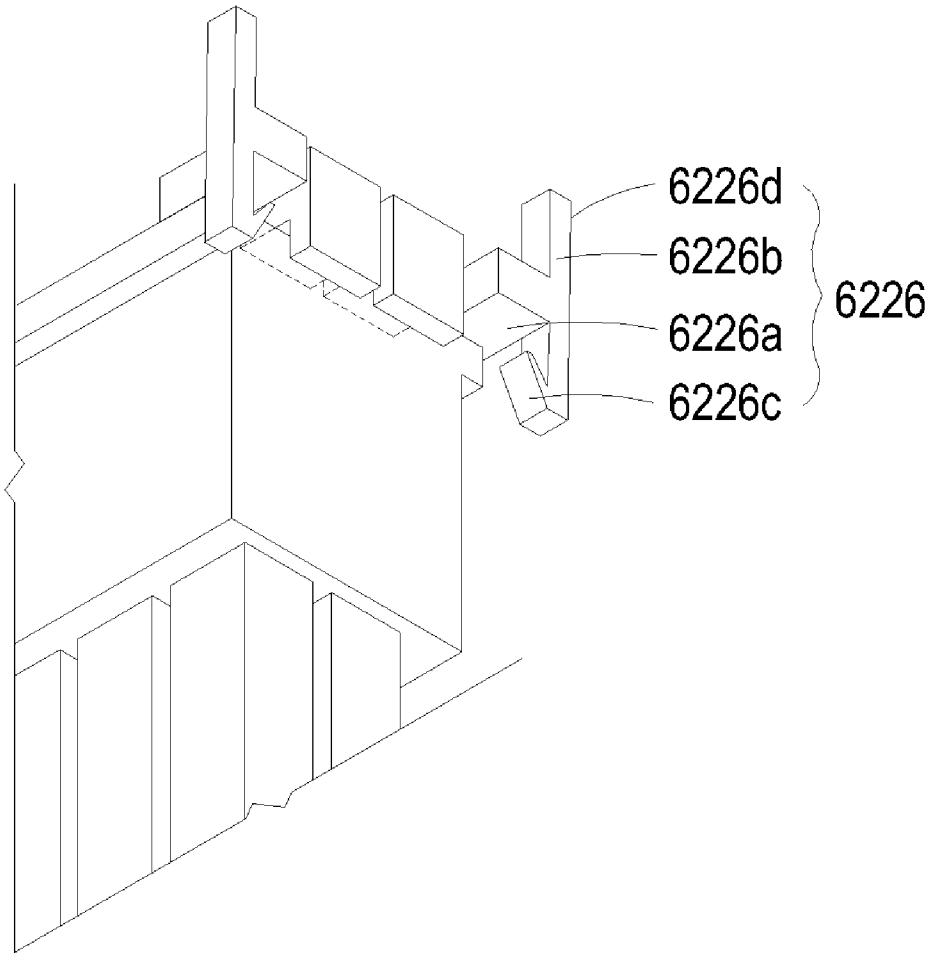
FIG. 7 is a schematic partial enlarged view illustrating a variant fastening element of the first connector.

It is noted that, however, those skilled in the art will readily observe that numerous modifications and alterations of the fastening element 6226 may be made while retaining the teachings of the invention. For example, as shown in FIG. 7, the other end of the arm part 6226*b* is formed as a force-exerting part 6226*d*. By applying an external force on the force-exerting part 6226*d*, the hooking part 6226*c* is shifted with respect to the connecting part 6226*a* in order to either combine the first connector 622 with the second connector 632 as a composite connector assembly or disengage the composite connector assembly.

Figure 10:
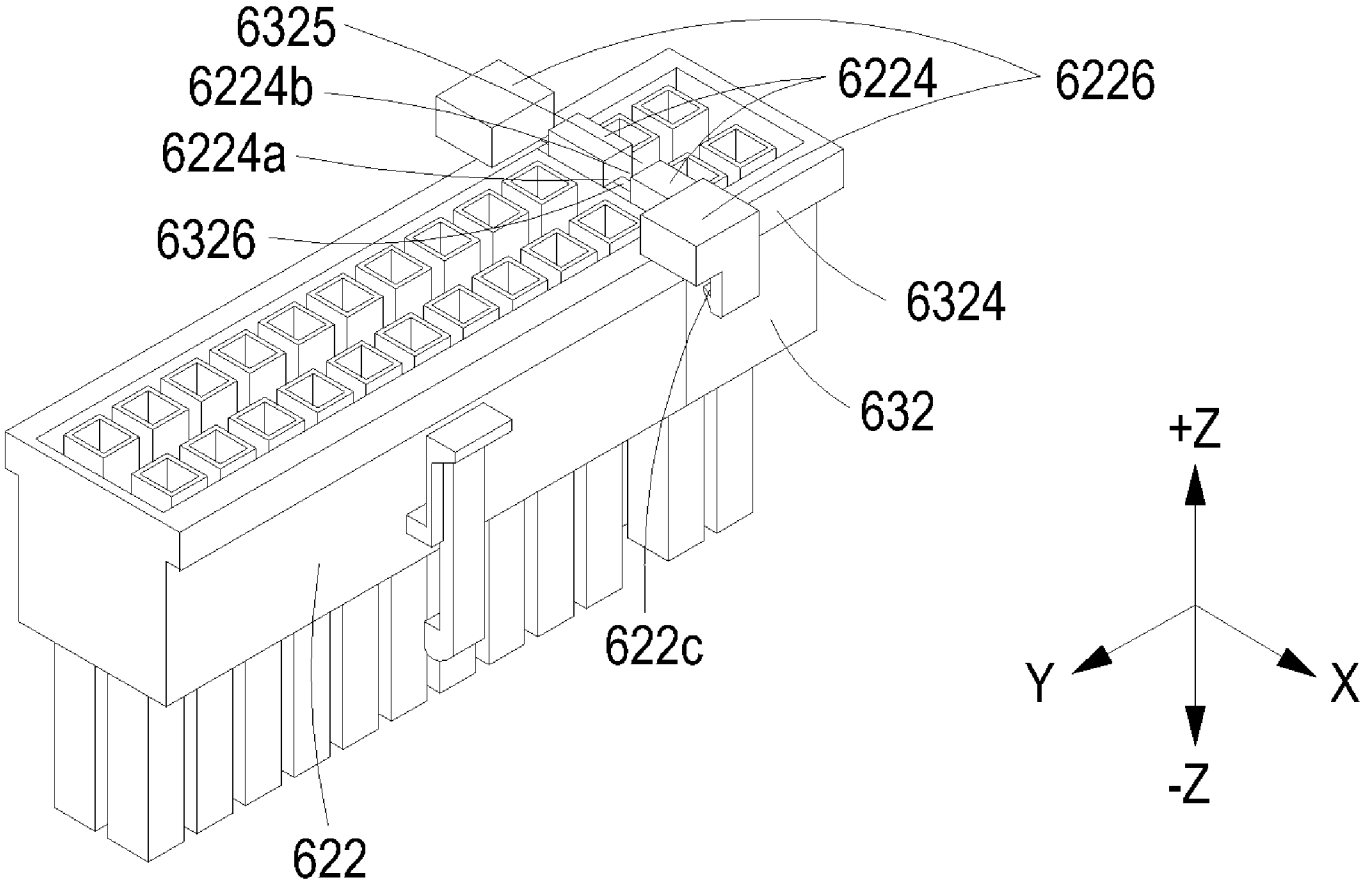
FIG. 10 is a schematic perspective view illustrating the composite connector assembly of the first connector and the second connector of FIG. 9.

Please refer to FIG. 5 again. The second connector 632 includes multiple (e.g. four) pins 6321. These pins 6321 are protruded from a second surface 6323 of the second connector 632, wherein the second surface 6323 is opposed to the first surface 6322. Furthermore, a receiving part 6325 (as shown in FIG. 10) is formed in the first surface 6322 of the second connector 632 for receiving the second cable 631 therein. In addition, the second connector 632 has an extension part 6324, which is extended from two opposite edges of the first surface 6322.

Figure 8B:
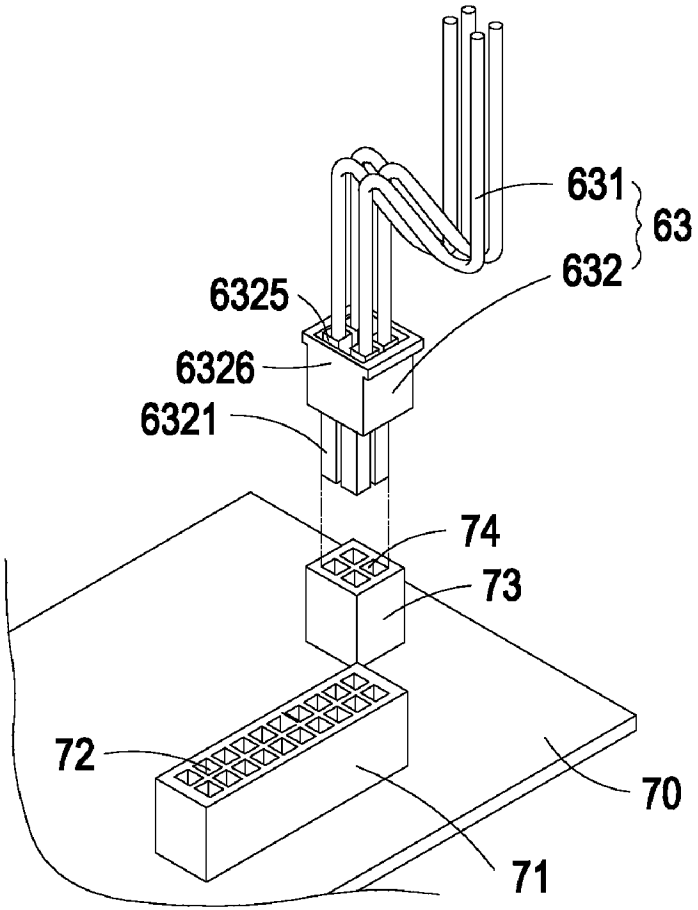
FIGS. 8A and 8B are partial exploded views illustrating the composite connector assembly of FIG. 5 to be used in a motherboard.
Figure 8A:
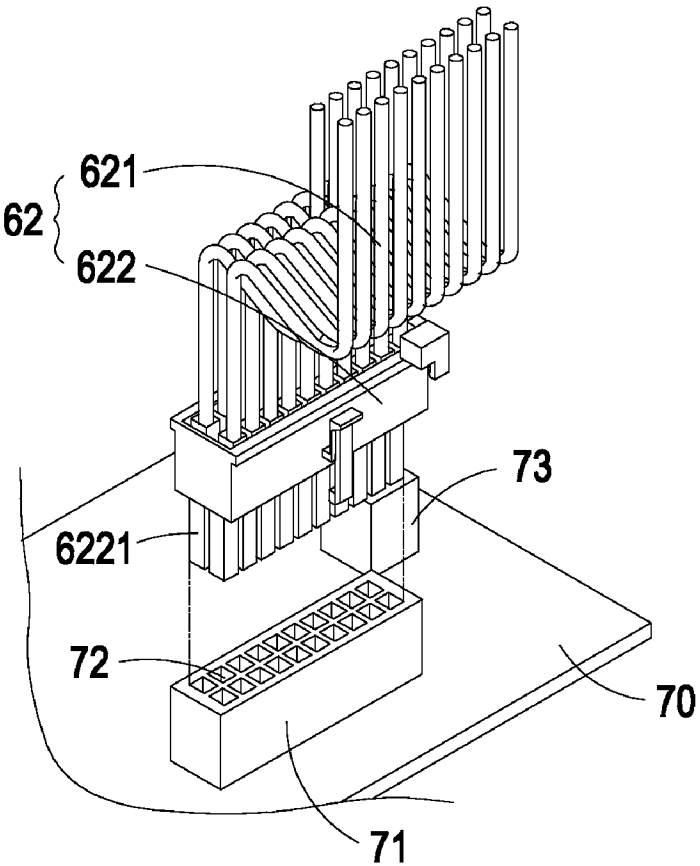

Please refer to FIGS. 8A and 8B, which are partial exploded views illustrating the composite connector assembly of FIG. 5 to be used in a motherboard. As shown in FIGS. 8A and 8B, the motherboard 70 has a first power socket 71 and a second power socket 73 mounted thereon. In a case that the first power socket 71 has twenty holes 72 and the second power socket 73 has four holes 74, the twenty pins 6221 of the first connector 62 and the four pins 6321 of the second connector 63 can be plugged into corresponding holes 72 and 74 of the sockets 71 and 73, respectively.

Figure 9:
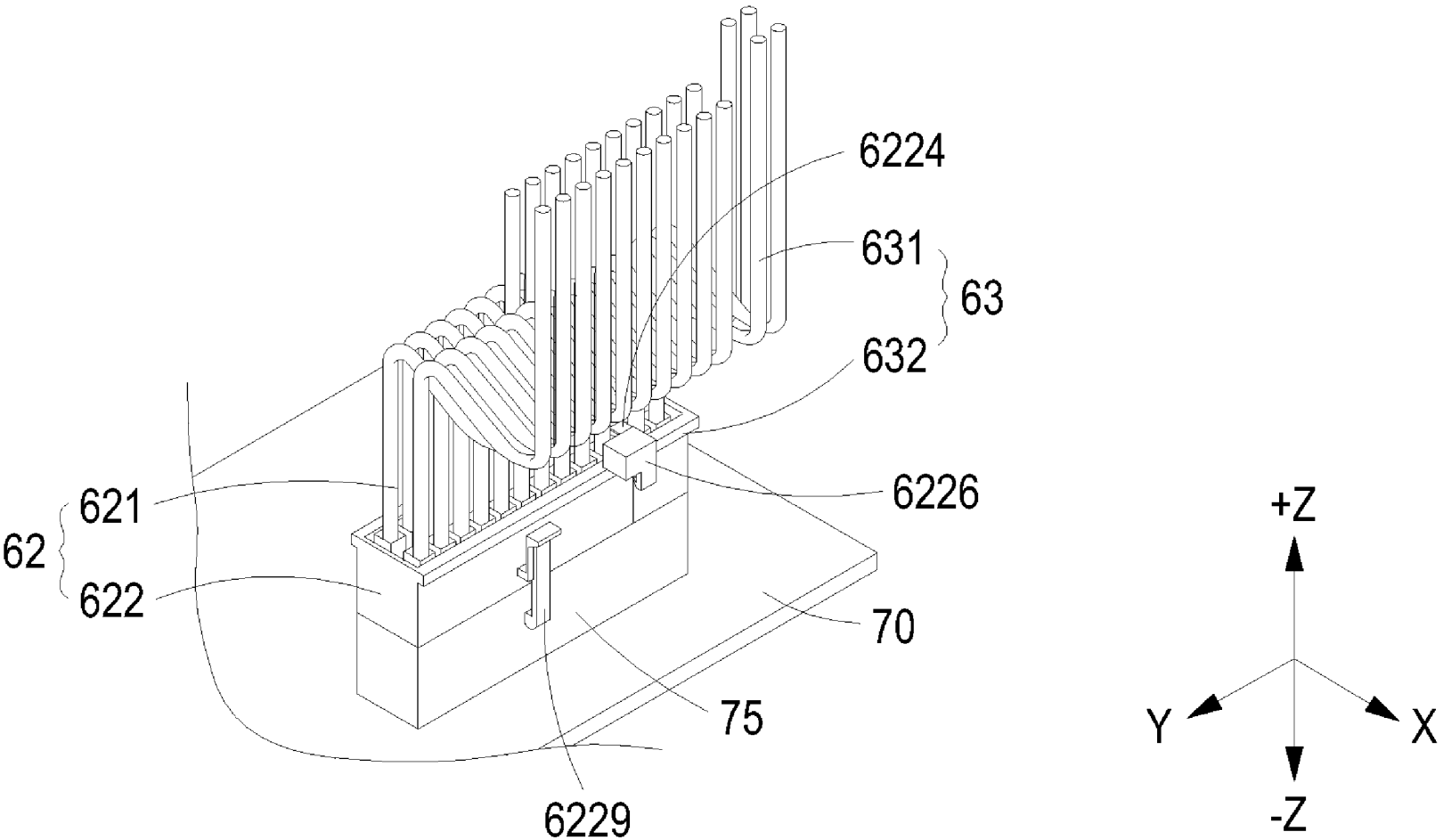
FIG. 9 is a schematic partial perspective view illustrating the composite connector assembly of FIG. 5 to be used in another motherboard.

Please refer to FIG. 9, which is a schematic partial perspective view illustrating the composite connector assembly of FIG. 5 to be used in another motherboard. The motherboard 70 of FIG. 9 has a first power socket 75 and a second power socket (not shown) mounted thereon. In a case that the first power socket 75 has twenty four socket holes, a total of twenty four pins of the first connector 622 and the second connector 632 can be securely fixed into corresponding socket holes of the first power socket 75.

FIG. 10 is a schematic perspective view illustrating the composite connector assembly of the first connector and the second connector of FIG. 9. Hereinafter, a process of plugging the first power output device 62 and the second power output device 63 into the common power socket 75 will be illustrated as follows with reference to FIGS. 5, 6, 9 and 10.

First of all, the second segment 6224*b* of the stop block 6224 of the first connector 622 is correspondingly embedded into the receiving part 6325 of the second connector 632, and a retaining wall 6326 of the second connector 632 adjacent to the receiving part 6325 (as shown in FIG. 8(B) is received in the L-shaped space defined by the first segment 6224*a* and the second segment 6224*b* of the stop block 6224 (as shown in FIG. 6) so as to latch the retaining wall 6326 of the second connector 632 with the stop block 6224 of the first connector 622. Meanwhile, the retaining wall 6326 is initially confined by the stop block 6224 to allow a tiny or none relative movement between the first connector 622 and the second connector 632 in the XY-plane. Since the fastening element 6226 is partially protruded from the first sidewall 6225 and the second sidewall 6227 of the first connector 622, the extension part 6324 of the second connector 632 will be clamped by the fastening element 6226 while the retaining wall 6326 is confined by the stop block 6224, thereby to lock the extension part 6324 of the second connector 632 by the fastening element 6226 of the first connector 622. As a result, the second connector 632 is securely attached onto the first connector 622 to form the composite connector assembly as shown in FIG. 10 without any shift in the Z-direction. Then, the twenty four pins of the composite connector assembly are inserted into corresponding socket holes of the common power socket 75. It is preferred that the socket holes of the common power socket 75 have specified foolproof mechanisms (not shown) to prevent erroneous insertion of the pins of the first connector 622 and the second connector 632.

In the above embodiments, the composite connector assembly of the present invention is manufactured by using the stop block 6224 and the fastening element 6226 of the first connector 622 to engage with the retaining wall 6326 and the extension part 6324 of the second connector 632, respectively. More especially, since the second connector 632 is a standard connector commonly used in the art, the composite connector assembly of the present invention is more cost-effective. Since a tiny or none relative movement between the first connector 622 and the second connector 632 are allowable in all directions, the composite connector assembly may be securely fixed in the common power socket 75. Moreover, two or more connectors may be selectively combined as the composite connector assembly in order to comply with the power sockets with different number of holes, thereby increasing flexibility to be applied in different instances. As a consequence, one power supply apparatus having the composite connector assembly of the present invention is sufficient to be used in various motherboards.

It is noted that, however, those skilled in the art will readily observe that numerous modifications and alterations may be made while retaining the teachings of the invention. For example, as shown in FIG. 9, the first connector 622 may include a resilient hooking element 6229 in order to facilitate fixing the first connector 622 in the first power socket 75. Alternatively, the power supply apparatus 6 may further include a third power output device and a fourth power output device. The operation principles of the third and fourth power output devices are similar to those of the first and second power output devices, and are not redundantly described herein. Alternatively, the first connector 622 may include multiple stop blocks 6224 and multiple fastening elements 6226.

From the above description, the composite connector assembly of the present invention is manufactured by using the stop block and the fastening element of the first connector to engage with the retaining wall and the extension part of the second connector, respectively. A tiny or none relative movement between the first connector and the second connector are allowable in all directions, so that the composite connector assembly may be securely fixed in the common power socket. Since the structure of the individual connector is very simple, the power supply apparatus of the present invention is cost-effective and user-friendly.

While the invention has been described in terms of what is presently considered to be the most practical and preferred embodiments, it is to be understood that the invention needs not be limited to the disclosed embodiment. On the contrary, it is intended to cover various modifications and similar arrangements included within the spirit and scope of the appended claims which are to be accorded with the broadest interpretation so as to encompass all such modifications and similar structures.

What is claimed is:

1. A power supply apparatus comprising:

a main body;

a power input device coupled to an input terminal of said main body;

a first power output device including a first cable and a first connector, wherein said first cable has a first end connected to said main body and a second end connected to a first surface of said first connector, and said first connector includes at least a stop block and at least a fastening element; and a second power output device including a second cable and a second connector, wherein said second cable has a first end connected to said main body and a second end connected to a first surface of said second connector, and said second connector includes an extension part extended from two opposite edges of said first surface and a retaining wall, wherein an edge of said retaining wall is confined by said stop block and said extension part is clamped by said fastening element so as to selectively combine said first connector with said second connector as a composite connector assembly and facilitate securely fixing said composite connector assembly in a common power socket, thereby transmitting electricity from said first and second output devices to said common power socket, wherein said stop block is extended from an edge of said first surface and protruded from a first sidewall adjacent to said first surface of said first connector; wherein said stop block includes a first segment and a second segment, wherein said first segment and said second segment are substantially perpendicular to each other, and said second segment is substantially parallel to said first sidewall, wherein said fastening element is extended from an edge or a corner of said first surface of said first connector and partially protruded from said first sidewall and a second sidewall of said first connector, said second sidewall being disposed adjacent to said first sidewall.

2. The power supply apparatus according to claim 1 wherein one of said first connector and said second connector has twenty pins, and the other one of said first connector and said second connector has four pins.

3. The power supply apparatus according to claim 2 wherein said pins of said first connector are protruded from a second surface opposite to said first surface of said first connector, and said pins of said second connector are protruded from a second surface opposite to said first surface of said second connector.

4. The power supply apparatus according to claim 1 wherein said first connector further includes an extension structure extended from two opposite edges of said first surface of said first connector.

5. The power supply apparatus according to claim 1 wherein said fastening element includes:

a connecting part connected to said first surface of said first connector;

an arm part substantially perpendicular to said connecting part; and a hooking part formed at an end of said arm part.

6. The power supply apparatus according to claim 5 wherein the other end said arm part is formed as a force-exerting part.

7. The power supply apparatus according to claim 1 wherein a receiving part is formed in said first surface of said second connector for receiving said second cable therein, and said stop block is partially embedded into said receiving part of said second connector so that said edge of said retaining wall is confined by said stop block.

8. A composite connector assembly of a power supply apparatus, said power supply apparatus comprising a main body, a first power output device including a first cable and a second power output device including a second cable, said composite connector assembly comprising:

a first connector having a first surface connected to said first cable and including at least a stop block and at least a fastening element; and a second connector having a first surface connected to said second cable and including an extension part extended from two opposite edges of said first surface and a retaining wall, wherein an edge of said retaining wall is confined by said stop block and said extension part is clamped by said fastening element so as to selectively combine said first connector with said second connector as a composite connector assembly and facilitate securely fixing said composite connector assembly in a common power socket, thereby transmitting electricity from said first and second output devices to said common power socket, wherein said stop block is extended from an edge of said first surface and protruded from a first sidewall adjacent to said first surface of said first connector; wherein said stop block includes a first segment and a second segment, wherein said first segment and said second segment are substantially perpendicular to each other, and said second segment is substantially parallel to said first sidewall, wherein said fastening element is extended from an edge or a corner of said first surface of said first connector and partially protruded from said first sidewall and a second sidewall of said first connector, said second sidewall being disposed adjacent to said first sidewall.

9. The composite connector assembly according to claim 8 wherein one of said first connector and said second connector has twenty pins, and the other one of said first connector and said second connector has four pins.

10. The composite connector assembly according to claim 9 wherein said pins of said first connector are protruded from a second surface opposite to said first surface of said first connector, and said pins of said second connector are protruded from a second surface opposite to said first surface of said second connector.

11. The composite connector assembly according to claim 8 wherein said fastening element includes:

a connecting part connected to said first surface of said first connector;

an arm part substantially perpendicular to said connecting part; and a hooking part formed at an end of said arm part, wherein the other end said arm part is formed as a force-exerting part.

12. The composite connector assembly according to claim 8 wherein a receiving part is formed in said first surface of said second connector for receiving said second cable therein, and said stop block is partially embedded into said receiving part of said second connector so that said edge of said retaining wall is confined by said stop block.

* * * * *